United States Patent [19]

Gragson

[11] 4,368,130

[45] Jan. 11, 1983

[54] PROCESS OF PREPARING GREASE COMPOSITION

[75] Inventor: James T. Gragson, Bartlesville, Okla.

[73] Assignee: Phillips Petroleum Company, Bartlesville, Okla.

[21] Appl. No.: 198,518

[22] Filed: Oct. 20, 1980

Related U.S. Application Data

[62] Division of Ser. No. 30,965, Apr. 17, 1979, Pat. No. 4,261,840.

[51] Int. Cl.[3] ..... C10M 1/40

[52] U.S. Cl. ..... 252/33.4; 252/18; 252/25; 252/33

[58] Field of Search ..... 252/18, 25, 33, 33.2, 252/33.4

[56] References Cited

U.S. PATENT DOCUMENTS

| | | | |
|---|---|---|---|
| 2,535,101 | 12/1950 | Sproule et al. | 252/33 |
| 2,854,408 | 9/1958 | Brugmann, Jr. et al. | 252/33 |
| 3,242,079 | 3/1966 | McMillen | 252/33 |
| 3,377,283 | 4/1968 | McMillen | 252/33 |
| 3,429,811 | 2/1969 | Robbins et al. | 252/18 X |
| 3,480,550 | 11/1969 | Henderson et al. | 252/33 |
| 3,523,898 | 8/1970 | De Vault | 252/33 |
| 3,629,109 | 12/1971 | Gergel et al. | 252/33 |

*Primary Examiner*—Andrew Metz

[57] ABSTRACT

A lubricating grease is formed by overbasing a mixture comprising lubricating oil, an alkaline earth metal petroleum sulfonate, and a lower molecular weight sulfonic acid derivative. The lubricating grease formed is highly basic and has a high drop point.

9 Claims, No Drawings

PROCESS OF PREPARING GREASE COMPOSITION

This application is a divisional of U.S. Pat. application having Ser. No. 030,965, filed Apr. 17, 1979 now U.S. Pat. No. 4,261,840.

BACKGROUND OF THE INVENTION

The present invention relates to a lubricating grease and a process for the preparation thereof. In another aspect, this invention relates to a lubricating grease formed by overbasing a mixture comprising a lubricating oil and an alkaline earth metal sulfonate in the presence of a lower molecular weight sulfonic acid derivative. In still another aspect, this invention relates to the formation of a lubricating grease by treating a lubricating oil and an alkaline earth metal petroleum sulfonate with an alkaline earth metal hydroxide or oxide, carbon dioxide, and an alcohol in the presence of a lower molecular weight sulfonic acid derivative.

Generally, the formation of a lubricating grease requires the use of a thickening agent. It has been found, surprisingly, that upon using a low molecular weight sulfonate in an overbasing process, a material having a grease-like consistency is obtained. Instead of an intractable gel which must be discarded or the normal fluid, overbased oil additive product obtained when employing an overbasing process, the use of a low molecular weight sulfonate in an overbasing process allows one to obtain a lubricating grease which has properties of being highly basic and having a high drop point.

Accordingly, it is an object of this invention to provide a highly basic lubricating grease that does not require a thickening agent.

Furthermore, it is also an object of this invention to provide a novel and simple process for forming a lubricating grease.

It is a further object of this invention to provide a novel and simple process for forming a lubricating grease having the characteristics of high basicity and a high drop point.

It is also an object of this invention to provide a method for inhibiting the corrosion of a surface by depositing on said surface a lubricating process.

Other objects, aspects, and the several advantages of this invention will be apparent to those skilled in the art upon a study of this disclosure and the appended claims.

SUMMARY OF THE INVENTION

This invention pertains to a lubricating grease and a process for the preparation thereof. Said lubricating grease is formed by overbasing a mixture comprising a lubricating oil, an alkaline earth metal sulfonate, and a lower molecular weight sulfonic acid derivative. The overbasing process comprises treating the mixture with an alkaline earth metal hydroxide or oxide, carbon dioxide and an alcohol. It has been found, surprisingly, that the presence of a lower molecular weight sulfonic acid derivative produces a product which is grease-like whereas the ommission of the low molecular weight sulfonates results in products that are quite fluid. Therefore, the present invention allows one to prepare a lubricating grease having not only a high drop point, but also a high basicity, by using a simple overbasing technique.

In a specific embodiment, this invention relates to overbasing a mixture of the lubricating oil and a calcium petroleum sulfonate in the presence of a low molecular weight sulfonic acid derivative.

DETAILED DESCRIPTION OF THE INVENTION

This invention pertains to a lubricating grease formed by overbasing a mixture comprising a lubricating oil, an alkaline earth metal petroleum sulfonate, and a lower molecular weight sulfonic acid derivative.

Alkaline earth metal petroleum sulfonates useful in the preparation of the lubricating grease of this invention are prepared by means which are well known in the art. One such convenient process is herein described, however, the present invention is not limited to the process described as any well known process can be used.

The base stock for sulfonation is selected from highly paraffinic, deasphalted, and solvent-refined petroleum fractions having a viscosity of about 180–230 SUS at 99° C. and having a viscosity index of at least about 85. A preferred material is a propane-fractionated, solvent-extracted, and dewaxed Mid-Continent oil of about 200–215 SUS at 99° C. having a viscosity index of about 85 to 100 or higher. The residual material from the propane fractionation contains the rejected asphalt and aromatic oils. Following the propane fractionation step the overhead oil fraction is solvent-extracted to remove additional aromatic hydrocarbons.

These oils are contacted with sulfonating agents such as fuming sulfuric acid, chlorosulfonic acid, and sulfur trioxide, a particularly preferred sulfonating agent being a solution of sulfur trioxide in liquid sulfur dioxide. The petroleum stocks are contacted with the sulfonating agents at a temperature of from about 10° to 95° C., preferably from 25° to 65° C. for about 1 to 90 minutes. The ratio of sulfonating agent to oil can vary considerably but generally is within the range of from about 0.1:1 to 1:1 on a weight basis, the sulfonating agent being calculated as 20 percent fuming sulfuric acid or equivalent.

The effluent from the sulfonation step is a petroleum sulfonic acid which is subsequently converted to an alkaline earth metal petroleum sulfonate. The preferred alkaline earth metal petroleum sulfonate is a calcium petroleum sulfonate. The remainder of the process, forming the alkaline earth metal petroleum sulfonate from the sulfonic acid, will be described with respect to the formation of a calcium petroleum sulfonate. The invention, however, should not be limited thereto as one skilled in the art could readily use the same process for forming other alkaline earth metal petroleum sulfonates by making the appropriate substitutions. Also, this process is only an example of one method of several that are well known in the art.

In one method, therefore, the petroleum sulfonic acid is contacted with an aqueous slurry of lime. Preferably, the petroleum sulfonic acid mixture has been flashed to remove $SO_2$, which can be recycled, and also diluted with a hydrocarbon such as naphtha. Sufficient lime is employed to neutralize the sulfonic acid present. The resulting solution of calcium petroleum sulfonate is then stabilized by heating under pressure, as for example, 175°–205° C. at 1000–1700 kPa (150–250 psig). The water is removed from the stabilized solution by such methods as evaporation. The resulting stabilized, substantially neutralized slurry comprising calcium sulfate, calcium hydroxide, calcium petroleum sulfonate, unreacted oil, and naphtha is either employed directly in the subsequent overbasing operation or is further refined by filtration and flashing to remove suspended solids and volatiles.

The petroleum sulfonic acid mixture which is neutralized to form the petroleum sulfonates normally includes appreciable amounts of various hydrocarbons not having the acid group so that when the sulfonate is formed, the resulting product is a mixture of hydrocarbons and petroleum sulfonates. When the sulfonic acid is neutralized with an excess of alkaline earth metal oxide or alkaline earth metal hydroxide to form the sulfonate, the resulting product has a relatively small alkaline reserve. Addition of a large excess of neutralizing material normally does not materially increase the alkaline reserve beyond this point, since the excess material is removed, for example, by filtration, prior to the use of the sulfonate in a lubricant. Hereinafter the mixture resulting from neutralization of petroleum sulfonic acid will be referred to as "alkaline earth metal petroleum sulfonate".

The lower molecular weight sulfonic acid derivatives useful with the alkaline earth metal petroleum sulfonate in preparing the grease of this invention generally correspond to the formula $RSO_3M$ wherein M is hydrogen, ammonium, or an alkali metal, with sodium and potassium being preferred, and wherein R is phenyl or alkyl substituted phenyl groups in which the alkyl groups generally contain from 1 to 24 carbon atoms per group. Hence the lower molecular weight sulfonic acid derivatives include benzenesulfonic acid, alkylbenzenesulfonic acids, mixtures thereof, and the ammonium, sodium, or potassium salts thereof.

Exemplary lower molecular weight sulfonic acid derivatives include, in addition to benzenesulfonic acid, p-toluenesulfonic acid, 3,5-dimethylbenzenesulfonic acid, 2,4,6-trimethylbenzenesulfonic acid, 4-t-butylbenzenesulfonic acid, 3-methyl-5-n-propylbenzenesulfonic acid, 3-n-hexylbenzenesulfonic acid, 4-n-dodecylbenzenesulfonic acid, 3,5-di-n-dodecylbenzenesulfonic acid, 4-cetylbenzenesulfonic acid, 4-stearylbenzenesulfonic acid, and the like, mixtures thereof, and the ammonium, sodium, and potassium salts thereof.

It is also within the scope of this invention to employ lower molecular weight sulfonic acid derivatives prepared from petroleum fractions, such as those described above for calcium petroleum sulfonate preparation. Although there is no criticality as to the molecular weight, it is preferred that petroleum fractions are used such that the resulting sulfonic acid derivatives are mixtures for which the average number of carbon atoms per molecule falls within the range of from about 6 to about 30 carbon atoms per molecule. Useful lower molecular weight sulfonic acid derivatives include sodium, potassium, and ammonium salts of petroleum sulfonic acids.

Although the sulfonic acid derivative in whose presence the lubricating grease is formed is referred to as the "lower molecular weight sulfonic acid derivative", it is to be pointed out that the molecular weight is not critical. The molecular weight is generally less than that of the alkaline earth metal petroleum sulfonate used in the process of the instant invention, hence, the reference as a lower molecular weight deriviative, however, there is no criticality as such. As long as the "lower molecular weight sulfonic acid derivative" corresponds to the definitions given above, no criticality is placed on the molecular weight.

Although the source of diluent lubricating oil is not critical, generally, the diluent lubricating oil suitable for use in this invention is a solvent-refined, substantially paraffinic oil generally having a viscosity of about 25 to 300 SUS at 37.8° C. such as that obtained as the lubricating oil fraction of a Mid-Continent crude oil. Since the properties of the resultant grease are dependent upon the viscosity of the diluent oil, it is particularly convenient to employ Mid-Continent solvent-extracted paraffinic neutral oils having a viscosity in the range of about 40 to 200 SUS at 37.8° C. which are suitable for formulating into lubricating oils of SAE 10 to 50 weights.

The process for preparing the grease composition comprises treating the lubricating oil with an alkaline earth metal petroleum sulfonate and a lower molecular weight sulfonic acid derivative with carbon dioxide in the presence of an alkaline earth metal hydroxide or oxide and an alcohol. This part of the process, treating the mixture with carbon dioxide in the presence of an alkaline earth metal hydroxide or oxide an an alcohol, is the overbasing of the mixture of oil, petroleum sulfonate and sulfonic acid derivative. The overbasing procedure employed is similar to generally known overbasing processes. Therefore, whenever a mixture is overbased in the context of this invention, this mixture has been treated with $CO_2$ in the presence of an alkaline earth metal or oxide and an alcohol. The process of this invention pertains, therefore, to overbasing a mixture comprising a lubricating oil, an alkaline earth metal petroleum sulfonate, and a lower molecular weight sulfonic acid derivative.

The preferred process in which the grease of this invention is produced is conducted by mixing in an appropriate mixing zone the alkaline earth metal petroleum sulfonate, diluent lubricating oil, lower molecular weight sulfonic acid derivative, an alcohol, and an alkaline earth metal compound selected from the group consisting of hydroxides, oxides and mixtures thereof. The mixture then passes into a blowing zone where it is contacted with carbon dioxide which is bubbled through the mixture. The $CO_2$-treated material is then passed to a flash zone from which alcohol is removed and thence to a filtration zone from which residual solids are removed, and an additional flash zone to remove the remaining volatiles.

The solvent system normally employed in the carbonation step can be common organic solvents such as toluene, naphtha, Stoddard solvent, etc., alone or in mixtures.

The amount of solvent normally employed in the carbonation step can vary over wide ranges depending on, e.g., fluidity of the alkaline earth metal petroleum sulfonate/diluent oil/sulfonic acid derivative mixture. Generally useful ranges of solvent concentration are 50–90 weight percent and preferably 60–85 weight percent based on the total weight alkaline earth metal petroleum sulfonate, diluent oil, sulfonic acid derivative and solvent.

Any suitable alcohol will be satisfactory for the practice of the present invention. However, the preferred alcohols to be used in the carbonation step generally have from 1 to about 4 carbon atoms, e.g., which include methanol, ethanol, n-propanol, isopropanol, and the butanols. The amount of alcohol generally employed is from about 3.5 to about 8 percent by weight and preferably 4 to 6 percent by weight based on total diluent oil, calcium petroleum sulfonate, sulfonic acid derivative and solvent.

The temperature employed in the carbonation step can vary greatly. Generally, however, the temperature employed is in the range from about 25° to 80° C. and preferably from 40° to 65° C.

The amount of carbon dioxide added during the carbonation step will generally be from about 0.2 to 0.8 moles carbon dioxide per mole of alkaline earth metal oxide or hydroxide, e.g., CaO or $Ca(OH)_2$, added in excess over that required to neutralize the petroleum sulfonic acid. It is preferable to employ from 0.4 to 0.8 moles $CO_2$ per mole of excess oxide or hydroxide. When larger amounts of $CO_2$ are added, little additional alkaline reserve is obtained.

The alkaline earth metal oxide and/or hydroxide added in the neutralization step will generally be at least the stoichiometric amount needed to neutralize the petroleum sulfonic acid. Generally, an excess of oxide or hydroxide or, more specifically, when calcium is the alkaline earth metal, lime, is added in the neutralization step, e.g., up to about 100 percent excess. If the reaction product is to be filtered after neutralization, it is usually desirable to avoid large excesses of hydroxide and oxide since the excess is removed in the filtration step. On the other hand, if filtration is not employed after neutralization, any excess hydroxide and oxide will be retained in the reaction mixture and subsequently utilized in the overbasing operation.

The amount of lower molecular weight sulfonic acid derivative can vary, however, the amount employed in the preparation of the inventive grease will generally be in the range of 2 to 25 parts by weight per 100 parts per weight of alkaline earth metal petroleum sulfonate and preferably in the range of 3 to 10 parts by weight.

The diluent lubricating oil can be employed in varying amounts depending on the characteristics of the grease desired. However, the lube oil is generally employed in amounts ranging from 0 to about 75 weight percent and preferably 40 to 60 weight percent based on total alkaline earth metal petroleum sulfonate, sulfonic acid derivative and diluent oil. It will be recognized by one skilled in the art that the amount of diluent oil employed, as well as the viscosity of the diluent oil as above stated, will affect the properties of the resultant grease.

Removal of the solvent by, e.g., flashing from the reaction product of the carbonation step yields the inventive grease. The thus-produced grease is useful as obtained or if desired, additives such as oxidation inhibitor, rust inhibitor, or extreme pressure additives, can be employed. Such additives can be added prior to removal of the solvent for ease of blending, or can be added to the grease by suitable mixing following removal of the solvent.

A better understanding of the invention will be obtained upon reference to the following illustrative examples, which are not intended, however, to unduly limit the invention.

EXAMPLE I

The following run illustrates the preparation of a lubricating grease by overbasing a mixture comprising diluent oil, calcium petroleum sulfonate and benzenesulfonic acid.

The calcium petroleum sulfonate employed in this run was prepared by sulfonating and neutralizing a propane-fractionated, phenol-extracted, and dewaxed Mid-Continent lubricating oil fraction of about 203 SUS viscosity at 99° C. and a viscosity index of about 93. This charge stock was sulfonated with a solution of about 10 weight percent $SO_3$ in liquid $SO_2$ at 43.5° C. for about 10 minutes. The $SO_3$/oil weight ratio was about 0.08/1. The sulfonation effluent was flashed to remove $SO_2$, leaving a solution of about 48 weight percent petroleum sulfonic acid in unsulfonated oil. This mixture was then diluted with petroleum naphtha and neutralized by addition of an aqueous slurry of calcium hydroxide more than chemically equivalent to the sulfonic acid present. This mixture was stabilized by heating, followed by drying in a flash tower, dilution with additional solvent and filtration to remove solids. The solvent was then removed by flashing to yield a concentrate which is substantially 50 weight percent each of calcium petroleum sulfonate and unsulfonated oil, this product with a total base number of 7.5 hereafter being referred to as an "additive concentrate".

A mixture of additive concentrate (10 gm), above-described Mid-Continent oil of about 100 SUS viscosity at 37.8° C. (10 gm), Stoddard solvent (40 gm), hydrated lime (12 gm), methanol (3 gm) and benzenesulfonic acid (0.5 gm) was carbonated for 20 minutes at 60° C. The resulting mixture was heated at 110° C. to expel water and methanol, filtered to remove solids and stripped of solvent. The resulting product was very viscous, almost grease-like with a TBN of 227.

EXAMPLE II

The following run illustrates the preparation of a lubricating grease by overbasing a mixture comprising diluent oil, calcium petroleum sulfonate and ammonium petroleum sulfonate.

The ammonium petroleum sulfonate employed in this run was prepared by ammonia neutralization of the petroleum sulfonic acid made by sulfonation as described in Example I of a petroleum fraction obtained as the first twenty-five percent overhead in the distillation of a blend of 80/20 SAE 10/SAE 20 lubricating oil base stock on a weight basis. Extraction of the neutralized reaction product with a water/isopropanol mixture followed by flashing the extract to remove volatiles resulted in separation of the ammonium petroleum sulfonate from the unreacted oil.

The overbasing operation was carried out as described in Example I except that ammonium petroleum sulfonate (0.5 gm) was employed in place of the benzenesulfonic acid of Example I. The resulting product was grease-like with a TBN of 166. No drop point was observed for the grease up to 237° C.

EXAMPLE III

The following run illustrates the preparation of a lubricating grease by overbasing a mixture comprising diluent oil, calcium petroleum sulfonate and sodium petroleum sulfonate.

The sodium petroleum sulfonate employed in this run was prepared by sodium hydroxide neutralization of the petroleum sulfonic acid made by sulfonation as described in Example I of a petroleum fraction of 40 SUS at 99° C. Extraction of the neutralized reaction product with a water/isopropanol mixture followed by flashing the extract to remove volatiles resulted in separation of the sodium petroleum sulfonate from the unreacted oil.

The overbasing operation was carried out as described in Example I except that sodium petroleum sulfonate (0.5 gm) was employed in place of the benzenesulfonic acid of Example I. The resulting product was very viscous and grease-like.

EXAMPLE IV

The following run illustrates the use of the grease of Example II as a lubricant for automobile wheel bearings.

The grease of Example II and a commercial grease were employed in a modification of ASTM D1263-61. The modifications to ASTM D1263-61 are the absence of grease in the hub and use of 325° F. spindle temperature instead of the specific temperature. Test results showed successful completion of the test with 2.7 gm leakage compared to 0.5 gm leakage for a commercial grease.

The test results indicated that the inventive grease successfully lubricated the wheel bearings during the specified test period.

Certain modifications of this invention will become apparent to those skilled in the art and the illustrative details enclosed are not to be construed as imposing unnecessary limitations on the invention.

I claim:

1. Process for preparing a grease composition comprising:

(a) preparing a mixture of:

(aa) an alkaline earth metal petroleum sulfonate obtained from an oil base stock having a viscosity in the range of 180 to 230 SUS at 99° C. and a viscosity index of at least 85, (bb) an alkaline earth metal oxide or hydroxide, (cc) an alcohol, (dd) a lower molecular weight sulfonic acid derivative selected from the group consisting of:

derivatives corresponding to the formula $RSO_3M$, where M is hydrogen, ammonium, or an alkali metal and R is phenyl or alkyl substituted phenyl, said alkyl having 1 to 24 carbon atoms, and alkali metal and ammonium salts of a petroleum sulfonic acid having an average number of carbon atoms of 6 to 30, (ee) a lubricating oil, and (ff) with the further proviso that the lower molecular weight sulfonic acid derivative is employed in a quantity in the range of 2 to 25 parts by weight based on 100 parts by weight of the alkaline earth metal petroleum sulfonate, and (b) contacting the mixture with carbon dioxide optionally in the presence of a solvent (c) removing said alcohol, solvent when employed and any water from the mixture and recovering said grease composition.

2. Process in accordance with claim 1 wherein said mixture further comprises an organic solvent.

3. Process in accordance with claim 1 wherein said lubricating oil is a Mid-Continent lubricating oil having a viscosity in the range of about 40 to 200 SUS at 37.8° C.

4. Process in accordance with claim 1 wherein the lower molecular weight sulfonic acid derivative is selected from the group consisting of benzenesulfonic acid, p-toluenesulfonic acid, 3,5-dimethylbenzenesulfonic acid, 2,4,6-trimethylbenzenesulfonic acid, 4-t-butylbenzenesulfonic acid, 3-methyl-5-n-propylbenzenesulfonic acid, 3-n-hexylbenzenesulfonic acid, 4-n-dodecylbenzenesulfonic acid, 3,5-di-n-dodecylbenzenesulfonic acid, 4-cetylbenzenesulfonic acid, 4-stearylbenzenesulfonic acid, and mixtures thereof.

5. Process in accordance with claim 1 wherein the amount of lower molecular weight sulfonic acid derivative is in the range of about 3 to 10 parts by weight per 100 parts by weight of alkaline earth metal petroleum sulfonate.

6. Process in accordance with claim 1 wherein the carbon dioxide-contacted mixture is treated to remove residual solids and volatile compounds subsequent to the contacting with $CO_2$.

7. Process in accordance with claim 1 wherein the alcohol has from 1 to 4 carbon atoms and the amount of alcohol employed is in the range of from about 3.5 to about 8% by weight based on the total weight of lubricating oil, alkaline earth metal petroleum sulfonate, sulfonic acid derivative and solvent when employed.

8. Process in accordance with claim 1 wherein the temperature in the carbon dioxide-contacting step is in the range of about 25° to 80° C.

9. Process in accordance with claim 1 wherein the amount of carbon dioxide added during step b is sufficient to add about 0.2 to 0.8 moles of carbon dioxide per mole of alkaline earth metal hydroxide or oxide.

* * * * *